United States Patent [19]

Reifenhäuser

[11] Patent Number: 4,820,459

[45] Date of Patent: Apr. 11, 1989

[54] PROCESS FOR MAKING SPUN-FILAMENT FLEECE FROM ENDLESS SYNTHETIC RESIN FILAMENT

[75] Inventor: Hans Reifenhäuser, Troisdorf, Fed. Rep. of Germany

[73] Assignee: Reifenhauser GmbH & Co. Maschinenfabrik, Troisdorf, Fed. Rep. of Germany

[21] Appl. No.: 119,400

[22] Filed: Nov. 10, 1987

[30] Foreign Application Priority Data

Apr. 25, 1987 [DE] Fed. Rep. of Germany ..... 3713862

[51] Int. Cl.[4] ..... D01D 5/12

[52] U.S. Cl. ..... 264/40.3; 264/210.8; 264/518; 264/555; 425/66

[58] Field of Search ..... 264/40.3, 40.5, 40.7, 264/210.8, 518, 555; 156/167, 350; 425/80.1, 83.1, 66

[56] References Cited

U.S. PATENT DOCUMENTS

| | | | |
|---|---|---|---|
| 2,881,471 | 12/1954 | Snow et al. | 425/72 |
| 3,684,416 | 8/1972 | Lenk | 425/72 |
| 3,707,593 | 4/1970 | Fukada et al. | 264/210 F |
| 3,787,195 | 1/1974 | Kirchheim | 65/9 |
| 3,802,817 | 4/1974 | Matsuki et al. | 425/66 |
| 3,812,553 | 5/1974 | Marshall et al. | 19/156.3 |
| 3,963,392 | 6/1976 | Goyal | 425/83 |
| 3,969,462 | 7/1976 | Stofan | 264/237 |
| 3,988,086 | 10/1976 | Marhsall et al. | 425/72 S |
| 4,017,580 | 4/1977 | Barbey | 264/210 F |
| 4,025,595 | 5/1977 | Mirhej | 264/103 |
| 4,141,772 | 2/1979 | Buell | 264/518 |
| 4,217,078 | 8/1980 | Buell | 425/81.1 |
| 4,285,646 | 8/1981 | Waite | 425/72 S |
| 4,318,676 | 3/1982 | Gerking et al. | 425/72 S |
| 4,340,563 | 7/1982 | Appel et al. | 264/518 |
| 4,388,056 | 6/1983 | Lee et al. | 425/83.1 |
| 4,442,062 | 4/1984 | Fujii et al. | 264/518 |
| 4,520,531 | 6/1985 | Hergeth | 19/105 |
| 4,553,996 | 11/1985 | Muschelknautz et al. | 425/80.1 |
| 4,612,150 | 9/1986 | De Howitt | 264/103 |
| 4,692,106 | 9/1987 | Grabowski et al. | 425/66 |

FOREIGN PATENT DOCUMENTS

| | | | |
|---|---|---|---|
| 2658518 | 6/1978 | Fed. Rep. of Germany | 264/40.3 |
| 2906618 | 8/1980 | Fed. Rep. of Germany | 264/237 |
| 47-50003 | 12/1972 | Japan . | |
| 51-007204 | 3/1976 | Japan . | |

*Primary Examiner*—Jan H. Silbaugh
*Assistant Examiner*—Allan R. Kuhns
*Attorney, Agent, or Firm*—Herbert Dubno

[57] ABSTRACT

The process for making the spun fleece proceeds in a filament-spinning unit having a spinning nozzle system, a cooling shaft, a stretching aperture, a diffuser shaft, a continuously moving fleece recovery conveyor and a device for feeding process air and for drawing outflowing air through the fleece recovery conveyor. The cooling shaft has a shaft wall provided with a plurality of air orifices. That allows process air required for cooling to be fed into the cooling shaft. That air flow at least partially is drawn through the fleece recovery conveyor. The thickness of the spun fleece is measured on the fleece recovery conveyor in the transport direction downstream of the diffuser shaft. The measured value is compared with a predetermined set value. On deviation of the measured value from the set value the setting angle of the air control flap or flaps which are located adjacent the entrance of the stretching aperture is changed. On a positive deviation of the measured value of the thickness from the set value the setting angle is increased, on a negative deviation the set value is reduced.

2 Claims, 3 Drawing Sheets

PROCESS FOR MAKING SPUN-FILAMENT FLEECE FROM ENDLESS SYNTHETIC RESIN FILAMENT

CROSS REFERENCE TO RELATED APPLICATIONS

This application is related to the commonly owned applications Ser. Nos. 119,141, 119,197, 119,398, 119,469, 119,339, all filed 10 Nov. 1987.

FIELD OF THE INVENTION

My present invention relates to a process for making spun fleece from synthetic resin filament.

BACKGROUND OF THE INVENTION

A process for making spun fleece or nonwoven mat from endless synthetic resin filament using a filament-spinning unit is known. The filament-spinning unit includes a spinning nozzle system, a cooling shaft, a stretching aperture, a diffuser shaft, a continuously moving fleece recovery conveyor and a device for feeding process air and for drawing outflowing air through the fleece recovery conveyor. The cooling shaft has a shaft wall provided with a plurality of air orifices and process air required for cooling is admitted through the air orifices to provide an air flow. The air flow is at least partially drawn through the fleece recovery conveyor.

According to the features of the known filament-spinning unit, the process parameters such as the flow rate of thermoplastic material, process air, the transport speed of the fleece recovery conveyor and the geometric parameters of the filament-spinning unit are set up so that the spun fleece is produced with as exact and as uniform a given thickness as possible. In other words it has a preset surface or area weight. However in the existing process and/or in the existing filament-spinning unit it is not possible to successfully correct or even control thickness deviations from a uniform thickness. The thickness deviations have up to now been considered as intrinsic to the system.

OBJECT OF THE INVENTION

It is an object of my invention to provide a process for making spun fleece or nonwoven mat from endless synthetic resin filament which avoids these drawbacks.

It is another object of my invention to provide a process for making a spun fleece from an endless synthetic resin filament in which on deviation of the thickness of the spun fleece from a given setpoint value the thickness can be easily corrected.

It is another object of my invention to provide a process for making spun fleece from endless synthetic resin filament in which on deviation of the thickness of the spun fleece from a setpoint value the thickness can be easily corrected over the entire fleece width and which can be easily performed in a filament-spinning unit.

SUMMARY OF THE INVENTION

These objects and others which will become more readily apparent hereinafter are attained in accordance with my invention in a process for making a spun fleece from an endless synthetic resin filament in a filament-spinning unit including a spinning nozzle system, a cooling shaft, a stretching aperture, a diffuser shaft, a continuously moving fleece recovery conveyor and a device for feeding process air and for drawing outflowing air through the fleece recovery conveyor. The cooling shaft has a shaft wall which is provided with a plurality of air orifices and process air required for cooling is admitted through the air orifices to provide an air flow. The air flow is at least partially drawn through the fleece recovery conveyor.

According to my invention the process further comprises measuring the thickness of the spun fleece on the fleece recovery conveyor in the transport direction downstream of the diffuser shaft, comparing at least one measured or average value of the thickness with at least one predetermined setpoint value and on a deviation of the measured value or values or the average value from the setpoint value or values a setting angle of at least one air control flap which is located adjacent the entrance of the stretching aperture is changed so that on a positive deviation of the measured value or values or the average value from the setpoint value or values (i.e. the measured or average value is larger than the setpoint value) the setting angle is made larger and on a negative deviation of the measured value or values or the average value from the setpoint value or values the setting angle is reduced.

In one example of the process for making a spun fleece according to my invention in the filament-spinning unit having at least one pair of opposing air control flaps forming a narrow outlet gap opposite the stretching aperture only one of a pair of air control flaps is operable to correct the deviation of the measured or average value from the setpoint value.

In another example of my invention in the filament spinning unit having at least one pair of opposing air control flaps forming a narrow outlet gap opposite the stretching aperture, both of the air control flaps are synchronously operable.

In the scope of my invention several and/or several pair of air control flaps are provided in succession in the direction of recovery of the endless synthetic resin filament.

The thickness of the spun fleece can be measured as a mean value over the entire spun fleece width or over a portion of the spun fleece width. Then in the scope of my invention this measured mean value can be exactly adjusted to a suitable setpoint value.

One particularly advantageous example of my invention however leads to a very homogeneous spun fleece thickness over the entire spun fleece width. Here the thickness of the spun fleece being measured over the entire spun fleece width at different measuring points $x_1, x_2, \ldots, x_n$ and the setting angle of the air control flap and/or air control flaps being adjusted differently at the adjusting points $y_1, y_2, \ldots y_n$ corresponding to the measuring points $x_1, x_2, x_n$.

Furthermore the air control flaps can be elastically deformable. The air control flaps can also be divided into segments which are each adjustable differently.

In the scope of the process of my invention the measurement of the thickness of the spun fleece can occur in an easy way. The simplest approach to the thickness measurement involves using transmitted radiation, for example produced by radioisotopes. It is understood that for adjustment of the air control flaps suitable positioning drives (e.g. servomotors) are provided.

The attained advantages of my invention are such that on deviation of the spun fleece thickness from a predetermined set value the thickness can be corrected to the setpoint value in an easy way while engaged in the filament-spinning apparatus so that a very exact and uniform thickness over the entire fleece width can be attained.

Of specially advantage is the fact that a filament-spinning apparatus equipped for performing the process of my invention does not differ substantially from the existing fleece-making apparatus when the additional measuring devices are included and the air control flap or flaps are provided. The finished product, namely the spun fleece made from an endless synthetic resin filament, is improved considerably in its quality.

BRIEF DESCRIPTION OF THE DRAWINGS

The above and other objects, features and advantages of my invention will become more readily apparent from the following description, reference being made to the accompanying highly diagrammatic drawing in which.

SPECIFIC DESCRIPTION

Figure 1:
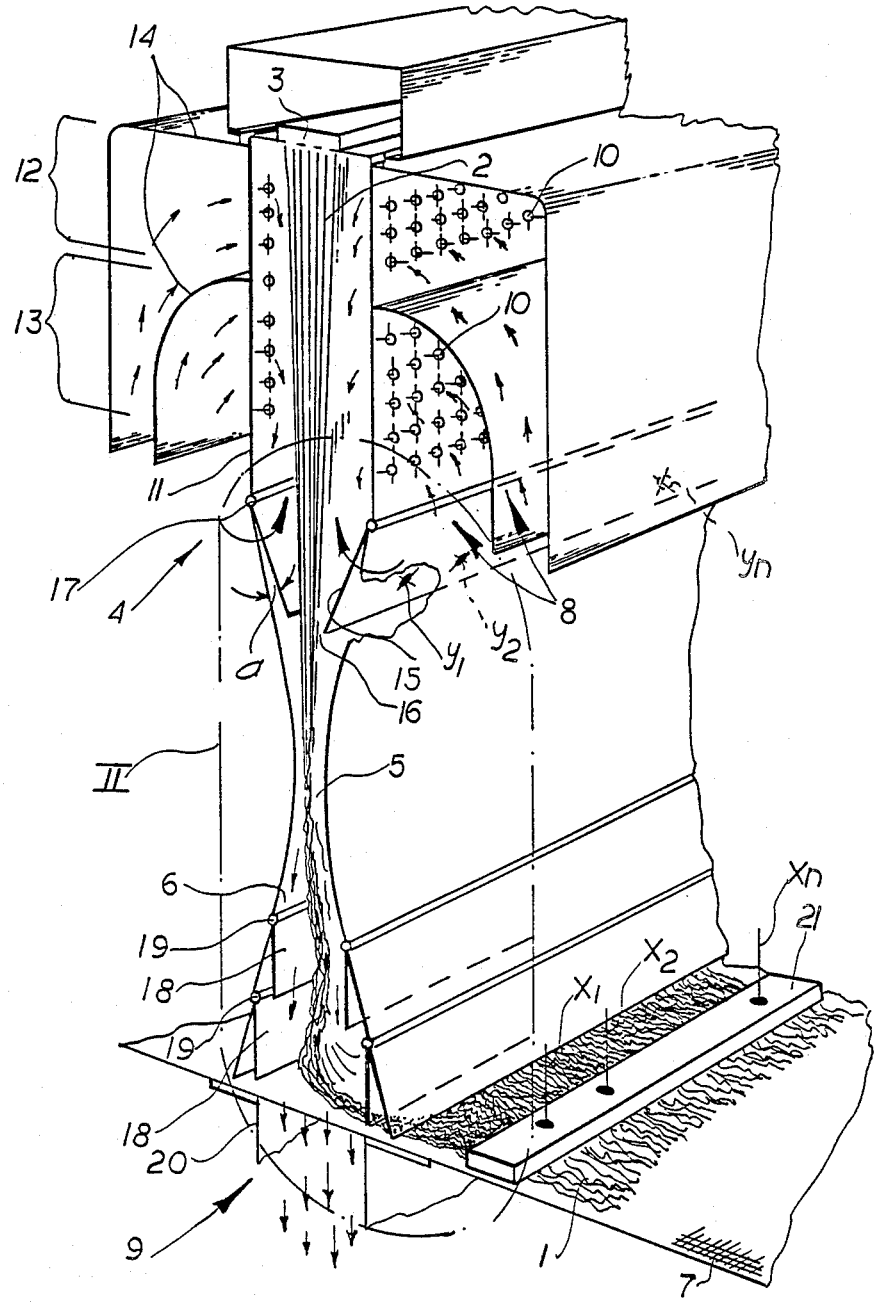
FIG. 1 is a perspective view of a vertically cutaway portion of a filament-spinning unit according to my invention.

The unit or apparatus shown in the drawing produces a spun fleece 1 made from endless synthetic resin filaments 2. This unit comprises a spinning nozzle system 3, a cooling shaft 4, a stretching aperture 5, a diffuser shaft 6 and a fleece recovery conveyor 7.

Devices 8, 9 for feeding process air and for drawing outflowing air through the fleece recovery conveyor 7 are provided.

The cooling shaft 4 has a shaft wall 11 provided with air orifices 10. The shaft wall 11 however can also be formed as a flow directing device in the form of a screen or grid. Because of this process air required for cooling is introducable into the cooling shaft 4.

The cooling shaft 4 has an upper intensive cooling region 12 and a lower additional cooling region 13 as well as suitable air flow dividing guiding walls or baffles 14 connected to the shaft wall 11. The air flow dividing guiding walls 14 are of adjustable height and the height of the intensive cooling region 12 is adjustable because of or by that height adjustability.

Figure 2:
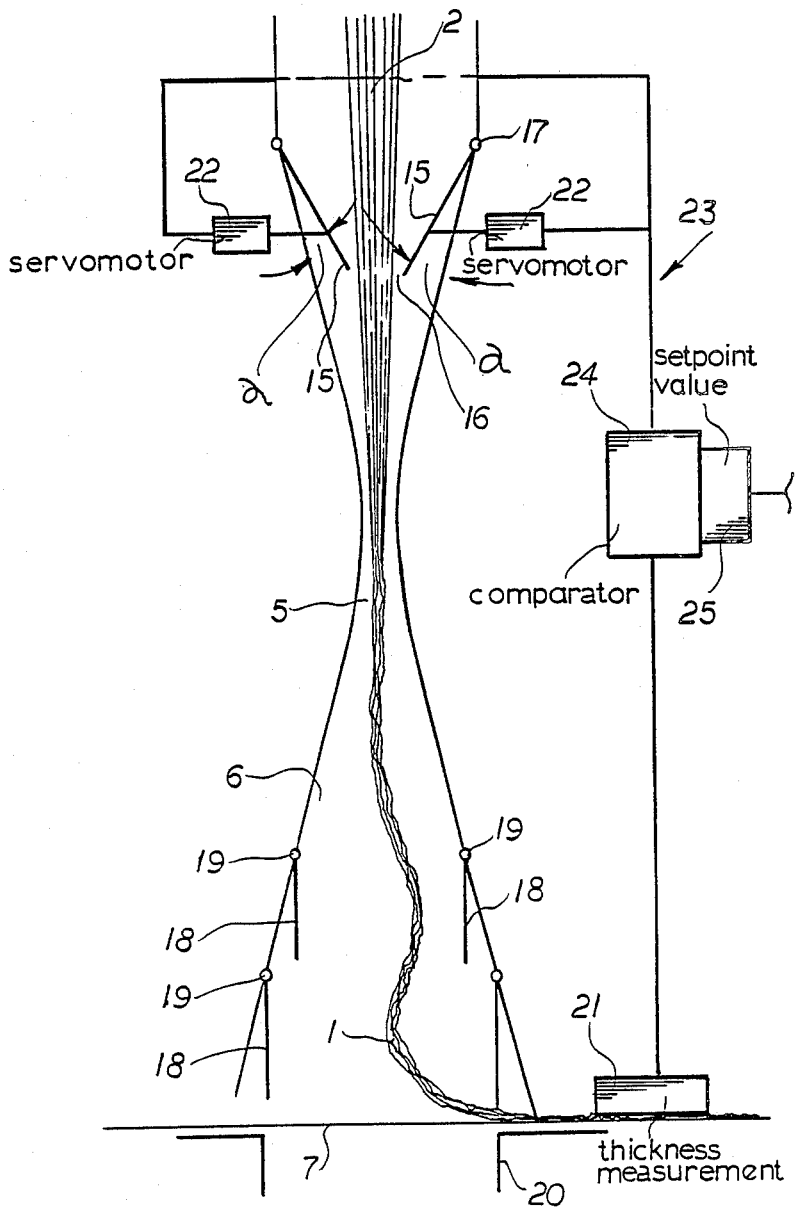
FIG. 2 is a magnified cutaway vertical cross sectional view of a part of the filament-spinning unit of FIG. 1 corresponding to the portion II indicated by the dot-dash line in FIG. 1.

Opposing air control flaps 15 on opposite sides of the unit, converging like a wedge in the feed direction of the endless filaments 2 and connected to the shaft wall 11 are connected in series with the stretching aperture 5. These flaps 15 have an outlet gap 16 which opens to the stretching aperture 5. In FIG.2 both these air control flaps 15 have an adjustable setting angle a (defined between the flap and the adjacent wall converging toward the stretching aperture 5) and are movable about a horizontal axis 17 as is indicated in FIG. 2 by curved arrows. The structure is designed so that the setting angles a and thus the width of the outlet gap 16 is adjustable differently over the entire length of the air control flap 15. For that appropriate positioning elements can be provided.

The diffuser shaft 6 is provided with pivotable wings 18 defining the flow cross section which are movable about a horizontal axis 19. Opposing pairs are positioned above each other in this example in several steps and are adjustable independently of each other. Also they can be set at different setting angles with suitable positioning elements.

The device 9 for drawing outflowing air has an adjustable damper 20 below the fleece recovery conveyor 7 (it can also be above the conveyor) with which the width of the outflowing air flow measured in the transport direction of the fleece recovery conveyor 7 is adjustable. It can be operated with a closed or partially closed air flow for the process air and for the outflowing air.

In any case the apparatus according to my invention does not operate with three separate air flows but with a single process air flow which, as described, is divided into a partial flow of air for the intensive cooling region 12 and a partial air flow for the additional cooling region 13.

The fleece recovery conveyor 7 which is a wire cloth conveyor is equipped with a thickness measuring device for the thickness of the spun fleece 1.

The thickness of the spun fleece 1 is thus measured over the spun fleece width at the measuring points $x_1, x_2, \ldots, x_n$ or of course at a single measuring point. The air control flaps 15 which are located upstream of the stretching aperture 5 and which each have a horizontal pivot axis 17 are adjustable relative to or against the air flow in regard to their setting angle a according to the deviation of the measured thickness value or values or an average thickness value from the predetermined setpoint value or value.

In FIGS. 1 and 2 two opposing air control flaps which are synchronously adjustable are provided. The air control flaps 15 are elastically deformable and consequently adjustable over their length with different adjusting angles a and of course with the adjusting points $y_1, y_2, \ldots, y_n$ corresponding to the measuring points $x_1, x_2, \ldots, x_n$. Different positioning drives 22 are indicated in FIG. 2.

The thickness measuring device 21, the positioning drives 22 of the air control flaps 15 with which the setting angle a is adjustable and the setpoint value adjustment are part of a feed back control loop 23 which was illustrated in FIG. 2 and to which a controller 24 with a setpoint value adjusting device 25 belong. A control of the thickness and thus a control of the surface weight results.

The thickness of the spun fleece 1 is measured on the fleece recovery conveyor 7 in the transport direction downstream of the diffuser shaft 6.

The measured value or values is compared with a predetermined setpoint value or values and on deviation of the measured value or values from the setpoint value or values the setting angle a of the air control flaps 15 which are located adjacent the entrance of the stretching gap 5 is changed. Of course on a positive deviation of the measured value or values from the setpoint value or values (measured value greater than setpoint value) the setting angle a is increased, on a negative deviation of the measured value from the setpoint value the setting angle a is reduced.

By the device for feeding process air I mean the shaft wall 11 with the air orifices 10, the baffles 14 and other similar members as well as an unillustrated air blower or pump.

Figure 3:
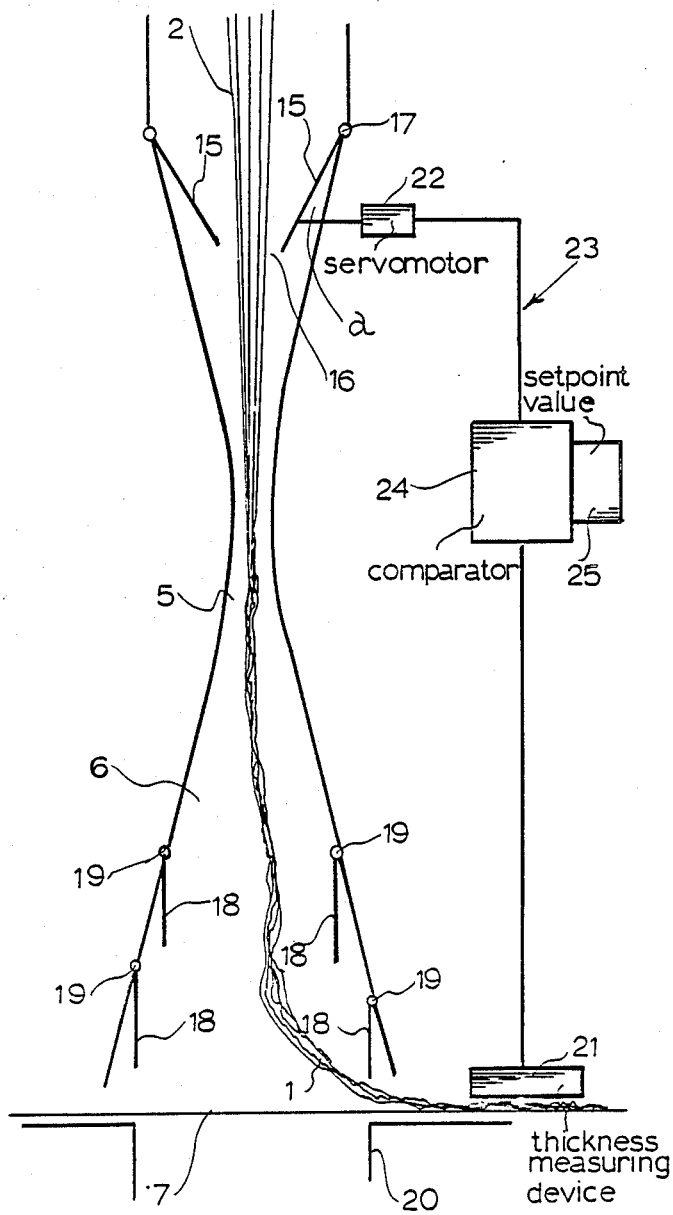
FIG. 3 is a magnified cutaway vertical cross sectional view of a part of the filament-spinning unit of FIG. 1 ccrresponding to the portion II as in FIG. 2 but in an alternative example of my invention.

FIG. 3 shows an additional example of my invention in which only one of the pair of opposing air control flaps 15 on opposite sides of the blower shaft adjacent the entrance of the stretching aperture 5 is controlled or adjusted by the positioning drive 22.

I claim:

1. A process for making a spun fleece from endless synthetic resin filaments, comprising the steps of:

(a) spinning a multiplicity of endless synthetic resin filaments in a downwardly directed spinning nozzle system so that spun filaments pass downwardly from said spinning nozzle system:

(b) passing said spun filaments through a cooling shaft below said spinning nozzle system and directing cooling air against said spun filaments in said shaft from opposite sides to cool said spun filaments;

(c) thereafter entraining the cooled filaments with said air through a stretching aperture defined between converging walls at an entrance side of said aperture, thereby stretching said cooled filaments (d) passing the stretched filaments through a downwardly diverging diffuser shaft below said stretching aperture;

(e) collecting said stretched filaments below said diffuser shaft as a spun fleece layer on a fleece-collecting conveyor movable generally horizontally in a downstream direction away from said diffuser shaft, while drawing at least part of said air through said fleece-collecting conveyor;

(f) measuring thicknesses of said spun fleece layer on said fleece-collecting conveyor at a plurality of measuring locations $x_1, x_2, \ldots x_n$ across a width of said layer and obtaining respective measured-thickness values;

(g) providing at said entrance side of said stretching aperture on opposite sides of cooled filaments respective flaps movable to define variable setting angles with the respective converging walls, said flaps extending generally horizontally across a width of said cooled filaments and at least one of said flaps being elastically deformable to permit establishment or different setting angles of the elastically deformable flap across the width of said cooled filaments;

(h) controlling flow through said stretching aperture by has been inserted comparing said measured-thickness values with a predetermined setpoint value and, upon a deviation of a measured-thickness value from the setpoint value, controlling the setting angle of the elastically deformable flap at a corresponding location $y_1, y_2 \ldots y_n$ across the width of said cooled filaments so that upon a positive deviation with the measured value greater than the setpoint the respective setting angle is increased and upon a negative deviation with the measured value less than the setpoint, the respective setting angle is decreased, thereby controlling the thickness of said spun fleece layer.

2. The process defined in claim 1 wherein both of said flaps are elastically deformable and the process further comprises the steps of synchronously controlling the setting angles of the other of said flaps with those of said one of said flaps at said corresponding locations $_1, y_2, \ldots y_n$.

* * * * *